United States Patent [19]

Allen

[11] 3,989,108

[45] Nov. 2, 1976

[54] WATER EXCLUSION METHOD FOR HYDROCARBON PRODUCTION WELLS USING FREEZING TECHNIQUE

[75] Inventor: Joseph C. Allen, Bellaire, Tex.

[73] Assignee: Texaco Inc., New York, N.Y.

[22] Filed: May 16, 1975

[21] Appl. No.: 578,244

[52] U.S. Cl. ..... 166/302; 166/306

[51] Int. Cl.[2] ..... E21B 43/16; E21B 43/24

[58] Field of Search ..... 166/302, 285, 303, DIG. 1, 166/314, 306

[56] References Cited

UNITED STATES PATENTS

| | | | |
|---|---|---|---|
| 1,342,781 | 6/1920 | Vedder | 166/302 X |
| 2,923,356 | 2/1960 | Glass et al. | 166/285 |
| 3,301,326 | 1/1967 | NcNamer | 166/302 X |
| 3,559,737 | 2/1971 | Ralstin | 166/302 X |
| 3,613,792 | 10/1971 | Hyde et al. | 166/DIG. 1 X |

*Primary Examiner*—Stephen J. Novosad
*Attorney, Agent, or Firm*—T. H. Whaley; C. G. Ries; Kenneth R. Priem

[57] ABSTRACT

The invention is a method for preventing water from entering a well in communication with a subterranean hydrocarbon reservoir wherein the well is completed in a hydrocarbon reservoir that contains a water column below the hydrocarbon. The well will or will very nearly transverse a portion of the water column. The well is completed in such a way that fluid may be injected into the lower portion of the reservoir through the well without communicating inside the well with fluid being produced through the well from the upper portion of the reservoir. Cold fluid is injected through the well into the lower portion of the reservoir near the water column while production at the same volmetric rate is taken through the well from the upper portion of the reservoir. The production is comprised mainly of the previously injected fluid. This cold fluid removes heat from the water column until the water freezes forming an ice barrier to fluid flow. After a sufficient ice barrier is formed, the rate of injection is reduced to a rate sufficient just to maintain the already formed ice barrier. The production rate is maintained at a rate higher than the reduced injection rate so that hydrocarbons from the reservoir are produced along with the injected fluid.

10 Claims, 1 Drawing Figure

V
14
13
15
19
21
18
15
11
12
16
22
INJECTED
CYCLE
FLUID

WATER EXCLUSION METHOD FOR HYDROCARBON PRODUCTION WELLS USING FREEZING TECHNIQUE

BACKGROUND OF THE INVENTION

1. Field of the Invention

This invention relates to the production of petroleum hydrocarbons from a subsurface reservoir which overlies a water column.

2. Description of the Prior Art

Often a petroleum hydrocarbon reservoir will overlay a substantially water saturated zone. When wells are drilled through this type of formation and production of hydrocarbons is begun, a problem referred to as water coning is often encountered. Water coning is a term given to the mechanism underlying the entry of bottom waters into producing wells. Petroleum hydrocarbons are often produced from porous subsurface formations which overlay a substantially water saturated porous formation. Under static conditions the water, being of greater density than the hydrocarbons, remains beneath and at the bottom of the hydrocarbon producing formation. However, at high rates of production of petroleum the upper boundry or surface of the substantially water saturated formation rises due to the increased flow of petroleum hydrocarbons into the wellbore. The wellbore usually extends into the liquid petroleum producing formation immediately adjacent and above the substantially water saturated formation. The rise of water into the hydrocarbon producing formation and into the wellbore represents a dynamic effect in which the upward directed pressure gradients associated with the flow of hydrocarbons into the producing wellbore are able to balance the hydrostatic head of the resulting elevated water column.

Various methods have been suggested to eliminate or reduce the water coning phenomenon. These methods have included reducing the well penetration into the hydrocarbon producing formation so that higher production rates are possible without at the same time experiencing a relatively increased production of water. Another method which has been suggested is to bottom the producing well into a substantially water impermeable formation. These indicated methods, however, cannot be successfully employed in all instances to eliminate or reduce water coning. Certain underground hydrocarbon producing formations are only relatively few feet in thickness. Accordingly, reducing the wellbore penetration to such a formation would unduly restrict the recovery of petroleum hydrocarbons therefrom. Other hydrocarbon producing formations do not have associated therewith an immediately underlying water impermeable formation such as a shale stringer.

One prior art method which has been shown to have some success in reducing the water coning problem is called "single wellbore cycling." In single wellbore cycling described in U.S. Pat. No. 2,832,416 the producing well is shut in for a period of time necessary to approach equilibrium conditions in the subsurface producing formations. During this period of time the water cone tends to flatten out. The time required depends on various circumstances and may be three hours to a month. After essentially equilibrium conditions have been reached, a liquid petroleum fraction is injected into and cycled within the hydrocarbon producing formation. After a sufficient amount of liquid petroleum has been injected and cycled to force the water in the petroleum producing formation to a substantial radial distance outwardly from the wellbore the injection of liquid petroleum is continued and petroleum production is commenced. This technique drastically changes the normal pressure gradients set up around the wellbore and prevents premature invasion or coning of water into the petroleum producing formation. The simultaneous injection/producing is accomplished by completing the well in such a way that injection of fluid into the lower part of the formation near the water column may be accomplished without communicating inside the wellbore with the hydrocarbons and other fluids being produced through the same well from the upper part of the formation. This may be accomplished by several arrangements of tubing and packers for example. Obviously, the injection rate of the recycled petroleum liquid will have to be less than the petroleum production rate as measured at the well head so that there is a net production of petroleum from the formation.

While this single wellbore cycling method finds application in many instances, it is not altogether successful in certain reservoirs. The method of this invention is a vast improvement over the single wellbore cycling method described above.

SUMMARY OF THE INVENTION

The invention is a method for preventing water from entering a well in communication with a subterranean hydrocarbon reservoir wherein the well is completed in a hydrocarbon reservoir that contains a water column below the hydrocarbon. The method entails forming an ice barrier between the water column and the hydrocarbon. The well transverses a portion of the water column. The well is completed in such a way that fluid may be injected into the lower portion of the reservoir through the well without communicating inside the well with fluid being produced through the well from the upper portion of the reservoir. Cold fluid is injected through the well into the lower portion of the reservoir near the water column while production at the same volumetric rate is taken through the well from the upper portion of the reservoir. The production at this point is comprised mainly of the previously injected fluid. This cold fluid removes heat from the water column until the water freezes forming an ice barrier to fluid flow. After a sufficient ice barrier is formed, the rate of injection is reduced to a rate sufficient to just maintain the already formed ice barrier. The production rate is then maintained at a rate higher than the reduced injection rate so that hydrocarbons from the reservoir are produced along with the injection fluid.

DESCRIPTION OF THE PREFERRED EMBODIMENTS

Figure 1:
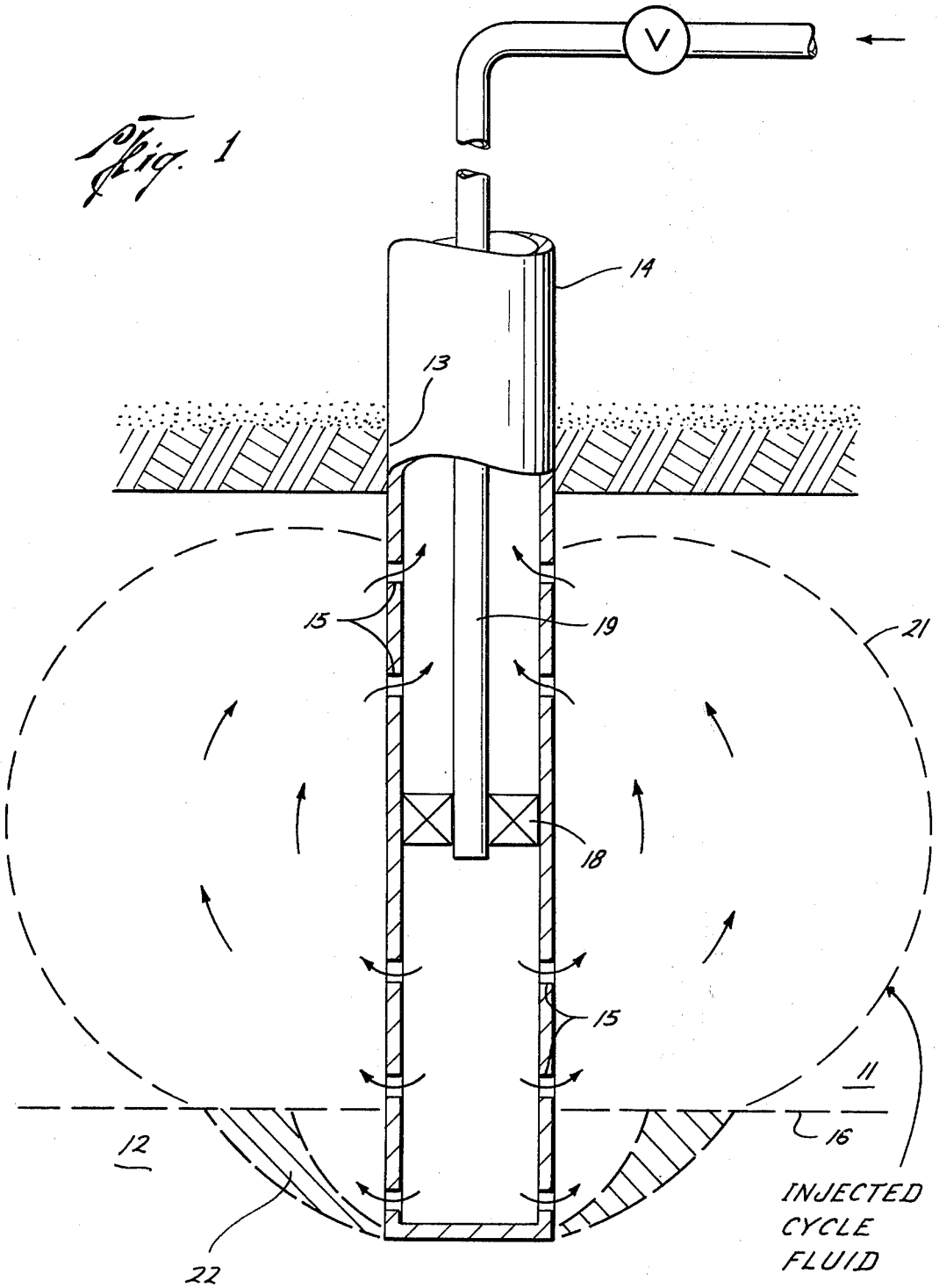
FIG. 1 is a depiction of the ice barrier formed around a wellbore in the practice of this invention.

In accordance with this invention, water coning is overcome by injecting into the hydrocarbon producing formation in the zone experiencing a water coning phenomenon a substantial amount of a cold fluid. This fluid removes heat from the formation so that the water adjacent to the wellbore is frozen forming an ice barrier which will prevent further encroachment of water into the wellbore.

Various fluids such as crude oil, petroleum fractions, gases, hydrocarbons, petroleum liquids and similar liquids may be employed in the practice of this invention in order that the fluids may be rendered cold enough to freeze substantial amounts of water in the wellbore. It is preferred that the fluids chosen include only those with freezing points well below that of the water encountered in the formation. Also, it is preferred to use fluids which will retain a relatively low viscosity at low temperatures so that they may be easily pumped into the formation and circulated back to the surface. Suitable fluids for the practice of my invention include the paraffinic series of fluids beginning with methane and proceeding through the paraffinic series until the fluid is either no longer suitable because it freezes above the freezing point of the water in the formation or becomes too viscous to be easily handled at low temperatures. Included among this paraffinic series of course, methane, ethane, propane, butane and mixtures of these also including pentane, hexane, heptane, octane and nonane. Nonane, for example, freezes at −60° F and the lighter paraffinic hydrocarbons mentioned of course freeze at lower temperatures.

Also, acceptable for the process of my invention are gases which can be reduced in temperature to very low points such as nitrogen, oxygen, carbon dioxide and the like. Aromatic hydrocarbons which have the necessary freezing and viscosity characteristics are also useful in the process of my invention. Many mononuclear aromatic hydrocarbons, however, have freezing points above that of water. Examples of mononuclear aromatic hydrocarbons having low freezing points suitable for my invention are toluene and meta- and orthoxylene. The above recitation of fluids is given for illustration and example only, and is not intended to be exhaustive of the fluids which will function in the process of my invention. Any competent practitioner will be able to find other fluids which will do an equivalent job and not depart from the scope of my invention.

My invention may be better understood by referring to FIG. 1, which is a schematically illustrated depiction of a preferred mode of my method. The wellbore 13 is provided with casing 14 which extends into the petroleum producing formation 11 which overlays a water column 12. In order to prevent and/or to reduce water coning when the production of the petroleum is commenced, the casing 14 is perforated within the petroleum producng formation 11 near the top thereof and near the bottom and/or in the upper part of the water producing formation 12 as illustrated. Packing 18 is then inserted within casing 14 intermediate the upper and lower perforations 15. Dashed line 16 indicates the normal interface between the hydrocarbons and the water portions in the reservoir. After packing 18 has been installed, a fluid such as LPG which is, of course, at a very low temperature is injected via conduit 19 into the formation 11 via the lower perforations 15 and the casing 14, and removed from formation 11 via the upper perforations 15 for recycle into conduit 19 and back to the surface via the annular space between the conduit 19 and casing 14. The injection of fluid into the formation 11 is continued until the water in the vicinity of the lower perforations has been frozen to form an impermeable ice barrier within the formation for a substantial radial distance surrounding that portion of wellbore 13 within formation 11. This ice barrier is indicated by 22. After a sufficient ice barrier has been formed the injection of LPG is reduced in rate and the production of petroleum from formation 11 through the upper perforations 15 is commenced at a higher rate than the reduced injection rate of the LPG. As the liquid petroleum flows through upper perforations 15 into production casing 14 upward directed pressure gradients are created which would ordinarily tend to lift the water table into the petroleum formation 11 into the area of the wellbore 13. However, the flow of water thereinto is resisted because of the ice barrier created above. Due to the continued but reduced injection of LPG, the ice barrier is maintained but not enlarged, and little or no water may cone into the production well. Therefore, the production well may produce substantial amounts of petroleum in perference to water production.

The practice of this invention is applicable not only to newly drilled wells, but is also applicable to previously drilled wells which are producing a considerable amount of water due to the phenomenon of water coning. Many variations on this invention which incorporate the basic heart of the invention may be thought of by those skilled in the art. These variations, however, are included in the scope of my invention if they contain the essential feature of forming an ice barrier in the reservoir.

I claim:

1. A method for preventing water from entering a well in communication with a subterranean hydrocarbon reservoir wherein the well is completed in a hydrocarbon reservoir that contains a water column underlying the hydrocarbon column, the completion being accomplished in such a way that fluid can be injected into the lower portion of the reservoir through the well without communicating inside the well with fluid being produced through the well from the upper portion of the reservoir comprising:

a. injecting a cold fluid into the lower portion of the reservoir through the well while producing at about the same volumetric rate through the well from the upper portion of the reservoir in such a way that heat is removed from the water column freezing the water in the portion of the water column nearest the wellbore; and b. reducing the fluid injection rate to a level which will maintain the ice formed in (a) while maintaining a fluid production rate about the reduced fluid injection rate to produce reservoir hydrocarbons diluted with the injected fluid.

2. A method as in claim 1 wherein the cold fluid is a petroleum fraction.

3. A method as in claim 1 wherein the cold fluid is crude oil.

4. A method as in claim 1 wherein the cold fluid is methane.

5. A method as in claim 1 wherein the cold fluid is ethane.

6. A method as in claim 1 wherein the cold fluid is propane.

7. A method as in claim 1 wherein the cold fluid is butane.

8. A method of claim 1 wherein the cold fluid is a mixture of paraffins.

9. A method as in claim 1 wherein the cold fluid is nitrogen.

10. A method as in claim 1 wherein the cold fluid is carbon dioxide.

* * * * *